US005327768A

United States Patent [19]

Yamashita

[11] Patent Number: 5,327,768

[45] Date of Patent: Jul. 12, 1994

[54] APPARATUS FOR MOUNTING FINGER FOR TRANSFER FEEDER

[75] Inventor: Hidetoshi Yamashita, Ishikawa, Japan

[73] Assignee: Kabushiki Kaisha Komatsu Seisakusho, Japan

[21] Appl. No.: 128,747

[22] Filed: Sep. 30, 1993

Related U.S. Application Data

[63] Continuation of Ser. No. 422,789, Oct. 17, 1989, abandoned.

[30] Foreign Application Priority Data

Oct. 20, 1988 [JP] Japan ..... 63-136078

[51] Int. Cl.[5] ..... B21D 43/05

[52] U.S. Cl. ..... 72/405; 198/621

[58] Field of Search ..... 72/405; 198/621, 583, 198/774.1; 414/750, 751

[56] References Cited

U.S. PATENT DOCUMENTS

| | | | |
|---|---|---|---|
| 4,680,954 | 7/1987 | Maeller | 72/405 |
| 4,693,361 | 9/1987 | Baba | 72/405 |

FOREIGN PATENT DOCUMENTS

| | | | |
|---|---|---|---|
| 3533850 | 7/1986 | Fed. Rep. of Germany | 72/405 |
| 232847 | 2/1986 | German Democratic Rep. | 72/405 |
| 108075 | 8/1979 | Japan | 72/405 |
| 60-160944 | 10/1983 | Japan | 72/405 |
| 59-49431 | 4/1984 | Japan | 72/405 |
| 107732 | 6/1984 | Japan | 72/405 |
| 163037 | 9/1984 | Japan | 72/405 |
| 61-152348 | 9/1986 | Japan | 72/405 |
| 63-53329 | 4/1988 | Japan | 72/405 |
| 63-31795 | 8/1993 | Japan | 72/405 |

*Primary Examiner*—Daniel C. Crane
*Attorney, Agent, or Firm*—Ronald P. Kananen

[57] ABSTRACT

This invention relates to an apparatus for mounting fingers for transfer bars for use in a transfer feeder wherein each of the fingers serving as workpiece gripping means can be moved without causing any interference of the finger with an adjoining finger or upright. This apparatus comprises moving plates located on end bars arranged, respectively, behind the left and right uprights on the front side of the press body and which are each connected to a two-stage tandem cylinder mounted on each of the central bars adapted to be taken out of the press body together with the moving bolster so that the moving plates may be moved freely in the longitudinal direction of the transfer bars which are dividable into a plurality of segments by means of the cylinder, and fingers mounted on the moving plates. Each of the fingers has a misgrip detector. Further, transmission couplers and access switches are provided to transmit a signal generated by the misgrip detector in non-contact state.

2 Claims, 4 Drawing Sheets

APPARATUS FOR MOUNTING FINGER FOR TRANSFER FEEDER

This application is a continuation of application Ser. No. 07/422,789 filed Oct. 17, 1989 now abandoned.

BACKGROUND OF THE INVENTION

1. Field of the Invention

This invention relates to an apparatus for mounting fingers for transfer bars for use in a transfer feeder arranged such that exchange of the fingers can be made outside the press body.

2. Description of the Prior Art

A transfer feeder for use with the conventional transfer press is arranged such that when an exchange of metal molds is made each of transfer bars is divided into a plurality of segments and the central bars thereof are taken out of the press body together with the metal molds so that an exchange of the fingers mounted thereon can be made outside the press body.

However, the above-mentioned transfer feeder has been disadvantageous because the transfer bars located behind the uprights of the press body are not taken out of the press body at the time of exchange of the metal molds, exchange of the fingers mounted on these transfer bars must be made inside the press body thus requiring many processes for the exchange.

To overcome such a disadvantage, there has already been proposed an apparatus for mounting fingers for transfer bars for use in a transfer feeder arranged such that the transfer bars located behind the uprights are also taken out of the press body together with the metal molds so that an exchange of the fingers mounted thereon can be made outside the press body.

However, the above-mentioned conventional apparatuses for mounting fingers for transfer bars for use in a transfer feeder have been disadvantageous in that depending on the size and configuration of the finger there is a risk of the finger interfering with an adjoining finger or a neighboring member such as an upright.

The above-mentioned conventional apapratuses are also disadvantageous in that when electric wiring for a misgrip detector mounted on the finger is automatically connected and disconnected by means of a plug socket the plug socket per se is liable to be damaged, and in case of those which do not use the plug socket, since retraction of the finger is made by dragging the electric wiring, there is a tendency of the electric wiring to be worn away quickly thus causing a failure or breakdown.

SUMMARY OF THE INVENTION

The present invention has been made in view of the above-mentioned circumstances in the prior art and for its object to provide an apparatus for mounting fingers for transfer bars for use in a transfer feeder wherein the fingers for gripping a workpiece can be moved without interfering with neighboring members.

To achieve the above-mentioned object, according to one aspect of the present invention, there is provided an apparatus for mounting fingers for transfer bars for use in a transfer feeder, the transfer feeder being arranged such that a pair of transfer bars serving as a workpiece conveying means located between front and rear uprights standing on the press body are each divided into a plurality of segments such as a central bar and end bars, respectively, and upon exchange of metal molds, a pair of corresponding central bars are taken out of the press body together with a moving bolster located in the press body, the apparatus comprising moving plates located on the end bars arranged, respectively, behind the left and right uprights on the front side of the press body and which are each connected to a two-stage tandem cylinder mounted on each of the central bars adapted to be drawn out of the press body together with the moving bolster so that the moving plates may be moved freely in the longitudinal direction of the transfer bars, and fingers mounted on the moving plates and serving as workpiece gripping means.

According to another aspect of the present invention, there is provided an apparatus for mounting fingers for transfer bars for use in a transfer feeder as set forth in the above-mentioned first aspect, each of the fingers mounted on the moving plates having a misgrip detector, the apparatus further comprising transmission couplers each installed on one of the moving plates and adapted to transmit a signal generated by their respective misgrip detector in a non-contact state, and a plurality of access switches associated with the transmission couplers, respectively, and mounted on the transfer bars within the range of movement of each of the moving plates.

The present invention incorporating the above-mentioned aspects will provide the following effects and advantages.

Stated in brief, each of the moving plates which can be moved freely by means of the two-stage tandem cylinder in the longitudinal direction of the transfer bar has attached thereto the finger for each of the end bars behind the left and right uprights on the front side of the press body so that when an exchange of metal molds is made the finger can be drawn on the side of the central bar which is a segment of the transfer. Therefore, the central bar can be taken out of the press body together with the moving bolster without causing any interference of the finger with an adjoining finger or upright depending on the size and configuration of the finger so that exchange of the finger outside the press body can be made thus achieving a substantial reduction in time required for exchange of the metal molds.

Further, according to the present invention, the arrangement is made such that a signal generated by the misgrip detector can be transmitted by the transmission coupler in a non-contact state, and therefore, as compared with the conventional apparatuses which require insertion and removal of a plug socket for processing the electric wiring, the disadvantages such as damage of the electric wiring and poor electric contacts by processing oil, etc. can be eliminated. The above-mentioned and other objects, aspects and advantages of the present invention will become apparent to those skilled in the art by making reference to the following detailed description and the accompanying drawings in which a preferred embodiment incorporating the principles of the present invention is shown by way of example only.

DETAILED DESCRIPTION OF THE PREFERRED EMBODIMENT

Figure 1:
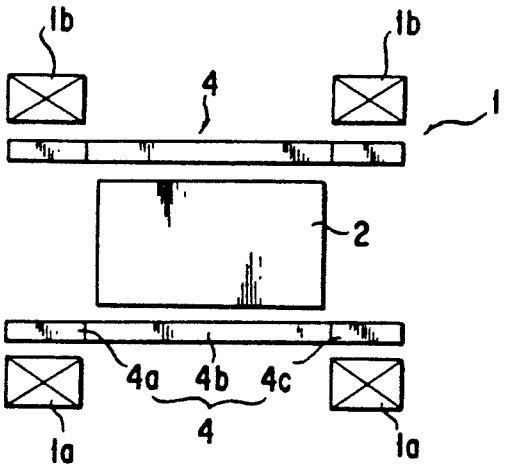
FIG. 1 is a schematic plan view of a transfer press having dividable transfer bars.

The present invention will now be described below in detail by way of example only with reference to the accompanying drawings.

In the drawings, reference numeral 1 denotes a press body having a moving bolster 2 adapted to be taken in and out freely and a pair of transfer bars 4, 4 disposed between front and rear uprights 1*a* and 1*b* and in parallel relationship with each other along the direction of conveyance of a work 3.

Figure 2:
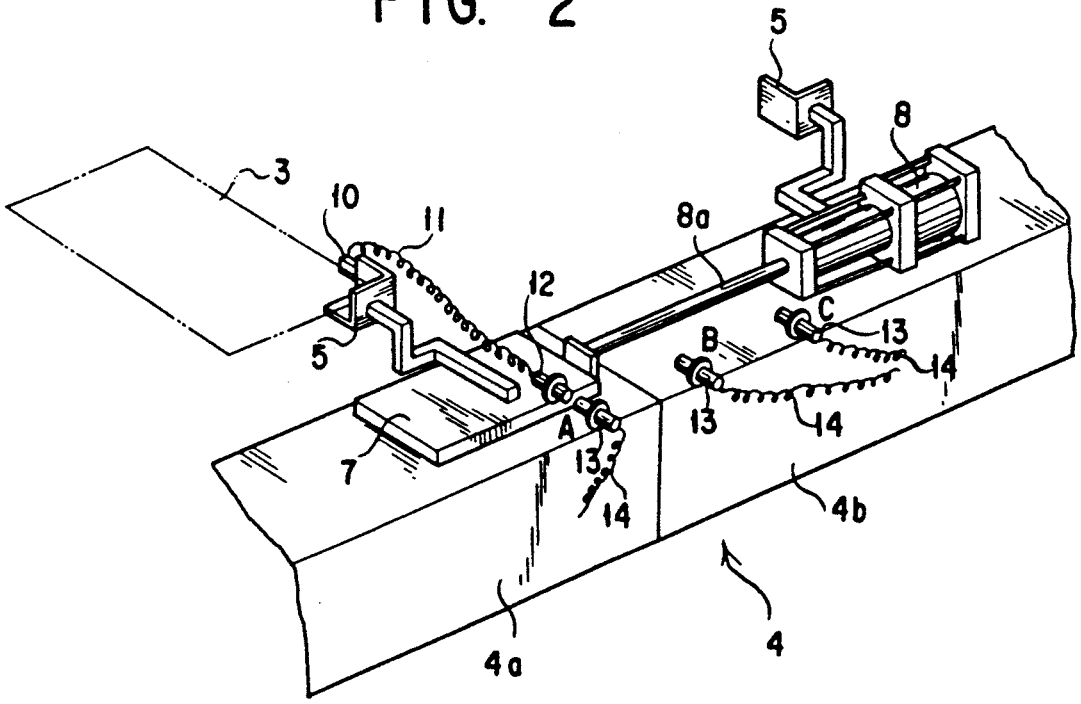
FIG. 2 is a schematic prespective view of transfer bar portions having one embodiment of the present invention attached thereto.

Each of the above-mentioned transfer bars 4, 4 is divided into three parts such as, for example, a central bar 4*b*, and end bars 4*a* and 4*c* so that the central bar 4*b* can be drawn out of the press body 1 together with the moving bolster 2 from between the left and right uprights 1*a*, 1*a*. As shown in FIG. 2, each of the end bars 4*a* and 4*c* has a finger 5 projecting therefrom and adapted to clamp the work 3 at positions opposite to each other.

Further, as shown in FIG. 2, the finger 5 provided on the side of each of the end bars 4*a* and 4*c* is fixedly secured to the upper surface of a moving plate 7 which is freely movable in the longitudinal direction on the end bars 4*a* and 4*c*, respectively.

And, one end of the above-mentioned moving plate 7 is connected to the leading end of a piston rod 8*a* of a two-stage tandem cylinder 8 installed on the central bar 4*b* so that the moving plate 7 can be moved by means of the two-stage tandem cylinder 8 onto the central bar 4*b*.

Figure 3:
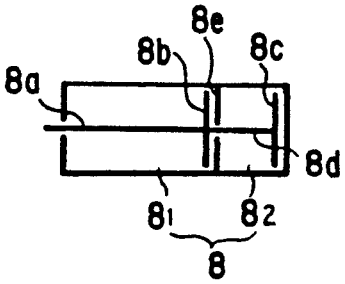
FIG. 3 is a schematic sectional view of a two-state tandem cylinder.

The above-mentioned two-state tandem cylinder 8 is of such a construction as shown in FIG. 3 wherein two cylinders $8_1$ and $8_2$ whose strokes are different are connected in series with each other, the cylinders $8_1$ and $8_2$ accommodating pneumatically or hydraulically actuated pistons 8*b* and 8*c*, respectively. The leading end of the above-mentioned piston rod 8*a* projecting from the piston 8*b* having a long stroke is connected to the moving plate 7, whilst the leading end of a piston rod 8*d* projecting from the piston 8*c* having a short stroke is arranged to pass through a bulkhead 8*e* into the cylinder $8_1$ in which the piston 8*b* having a long stroke is accommodated.

Further, as shown in FIG. 2, at the leading end of the above-mentioned finger 5, there is provided a misgrip detector 10 adapted to detect mis-grip of the work 3. One end of an electrical cable 11 is connected with the above-mentioned misgrip detector 10, and the other end thereof is connected with a transmission coupler 12.

Figure 4:
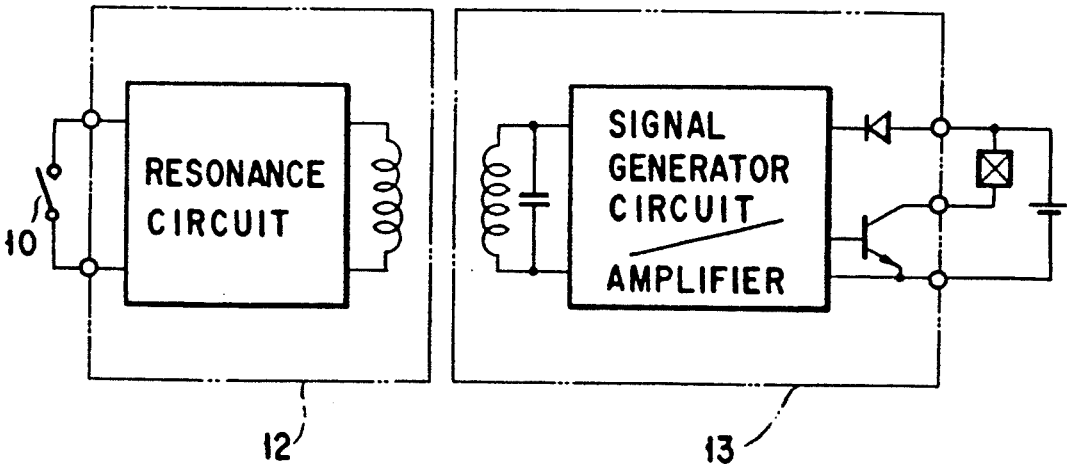
FIG. 4 shows circuit diagrams for a transmission coupler and an access switch.

The above-mentioned transmission coupler 12 is arranged such that a signal may be transmitted in a non-contact state between the coupler and each of the access switches 13 installed at a long stroke position A, a short stroke position B and a retracted position C, respectively. The coupler 12 and the access switch 13 have their own circuits shown in FIG. 4.

Further, each of the above-mentioned access switches 13 is connected through an electrical cable 14 with a central panel not shown so that detection of misgrip and the position of the moving plate 7 can be made.

The operation of the apparatus will now be described below.

Figure 5A:
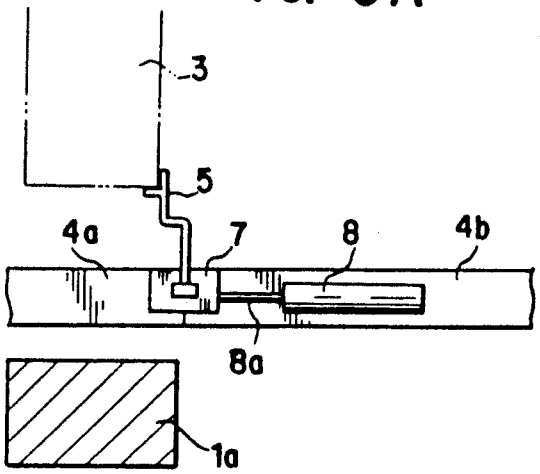
FIGS. 5A to 5C, 6A to 6C, 7A to 7C and 8A to 8C are explanatory views to show the operation of the embodiment according to the present invention.
Figure 5B:
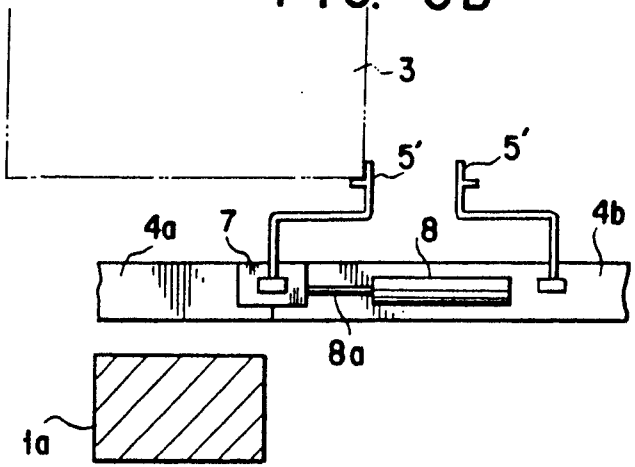
Figure 5C:
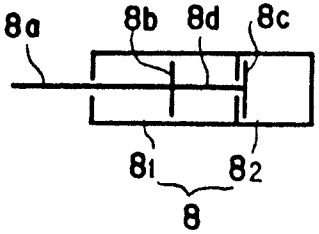

During the operation of the transfer press, fingers 5, 5' which are suitable for the size of the work 3 and which are attached to the moving plate 7 as shown in FIGS. 5A and 5B are used. When fluid under pressure is supplied into the cylinder $8_2$ of the two-stage tandem cylinder 8, the pistons 8*b* and 8*c* are moved as shown in FIG. 5C so that the moving plate 7 may be moved by these pistons 8*b* and 8*c* on the connection of the central bar 4*b* with the end bars 4*a* and 4*c*.

Figure 6A:
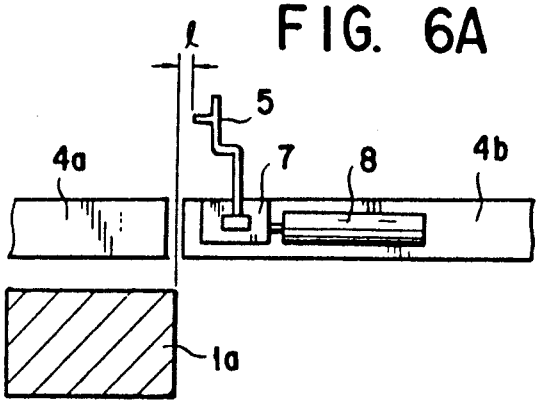
Figure 6B:
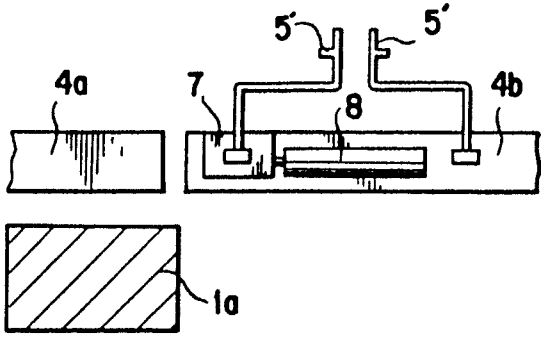
Figure 6C:
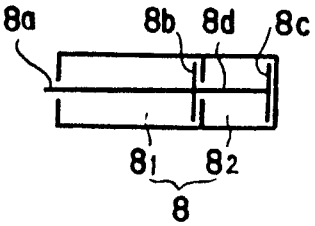

In case the transfer bars 4 are divided from this state and the central bars 4*b* are drawn out together with the moving bolster 2, first of all, fluid under pressure is supplied into the cylinder $8_1$ of the two-stage tandem cylinder 8 so that the pistons $8_b$ and $8_c$ within the cylinders $8_1$ and $8_2$, respectively, may be moved back to their positions shown in FIG. 6C.

As a result, the moving plate 7 is drawn from the position of the connection of the central bar 4*b* with the end bars 4*a* and 4*c* onto the side of the central bar 4*b* as shown in FIG. 6A and FIG. 6B. At that time, even if the finger 5 for a small work is mounted on the moving plate 7, it is ensured that a clearance "l" is created between the leading end of the finger 5 and the upright 1*a* as shown in FIG. 6A with the result that even if the central bar 4*b* is drawn out of the press body 1 together with the moving bolster 2 in this condition there is no risk of the finger 5 interfering with the upright 1*a*.

Further, even when the finger 5' for a large work is mounted on the moving plate 7, there is no risk of the finger 5' interfering with the adjoining finger 5' mounted on the central bar 4*b*.

Figure 7A:
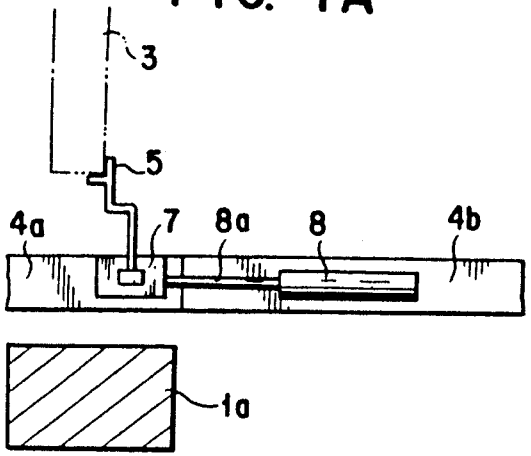
Figure 7B:
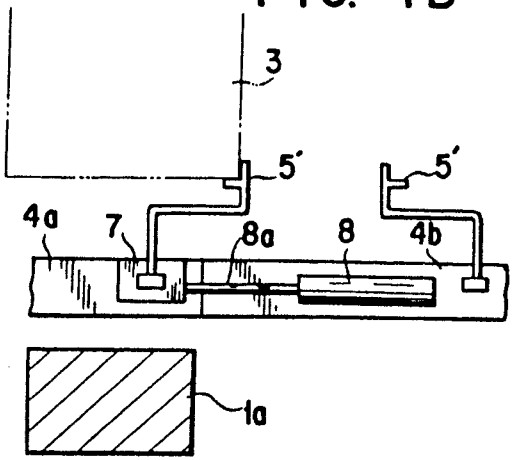
Figure 7C:
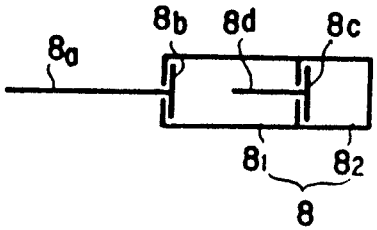

Whilst, in case the size of the work 3 is further smaller, fluid under pressure is supplied into the cylinder $8_1$ of the two-stage tandem cylinder 8 as shown in FIG. 7C so that the moving plate 7 may be moved by the piston 8*b* within the cylinder $8_1$ onto the side of the end bar 4*a* as shown in FIG. 7A. This enables the apparatus to cope with even a small work 3, and also the use of finger 5' for a medium-sized work enables the apparatus to handle even a medium-sized work 3.

Figure 8A:
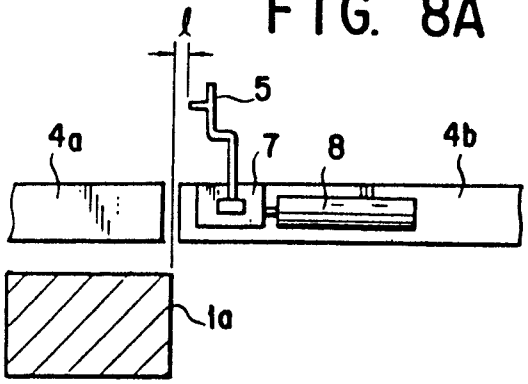
Figure 8B:
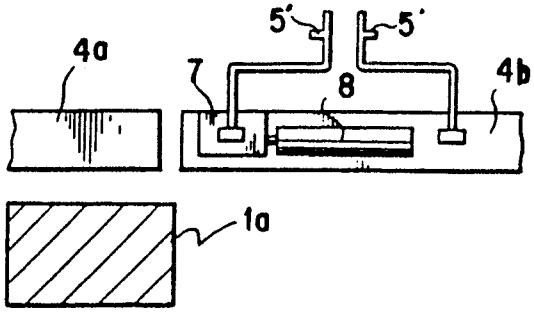
Figure 8C:
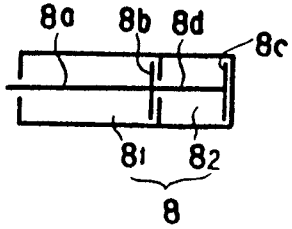

In case it is desired to divide the transfer bars 4 in this condition and draw out the central bars 4*b* together with the moving bolster 2, fluid under pressure is supplied into the cylinder $8_1$ of the two-stage tandem cylinder 8 so as to move the pistons 8*b* and 8*c* back to their positions as shown in FIG. 8C.

This ensures that a clearance "l" is created between the leading end of the finger 5 for a small work and the upright 1*a* as shown in FIG. 8A so that there is no risk of the finger 5 interfering with the upright 1*a*. Further, in case of the finger 5' for a large work, there is no risk of the finger 5' interfering with the adjoining finger 5' installed on the central bar 4'.

Thus, by drawing the central bars 4*b* out of the press body 1 together with the moving bolster 2 in this condition, an exchange of the finger 5 can be effected outside the press body, and upon completion of the exchange of the finger 5 and the metal molds, respectively, it is only necessary to set the finger 5 after connecting the transfer bar 4 according to the sequence reverse to the above-mentioned one.

It is to be understood that the foregoing description is merely illustrative of a preferred embodiment of the present invention, and that the scope of the invention is not to be limited thereto, but is to be determined by the scope of the appended claims.

What is claimed is:

1. An apparatus for mounting fingers for transfer bars for use in a transfer feeder in a press body with front and rear, left and right uprights, comprising:

a pair of transfer bars for conveying a workpiece, each of said transfer bars being divided into a central bar; and first and second end bars extending from said central bar; said central bar being located between the uprights;

a two-stage tandem cylinder mounted on said central bar;

a moving plate attached to said two-stage tandem cylinder capable of moving between said central bar and one of said first and second end bars by actuation of said two-stage tandem cylinder;

fingers attached to said moving plate for gripping a workpiece and transferring said workpiece to and from a metal mold positioned within said uprights by movement of said pair of transfer bars; and a moving bolster with said metal mold located between said central bars;

wherein when a metal mold must be exchanged in said press body, said two-stage tandem cylinder retracts said moving plate and its fingers from said end bar to said central bar so that said central bars and moving bolster can be removed from said press body without interference by either of said fingers or said uprights.

2. An apparatus for mounting fingers for transfer bars for use in a transfer feeder as claimed in claim 1, each of said fingers mounted on the moving plates has a misgrip detector, the apparatus further comprising transmission couplers each installed on one of the moving plates and adapted to transmit a signal generated by their respective misgrip detector in non-contact state, and a plurality of access switches associated with the transmission couplers, respectively, and mounted on said transfer bars within the range of movement of each of said moving plates.

* * * * *